United States Patent [19]

Hagenbach et al.

[11] 4,019,903

[45] Apr. 26, 1977

[54] ELECTROSTATIC DEVELOPMENT

[75] Inventors: Robert J. Hagenbach, Rochester, N.Y.; Robert D. Fenity, deceased, late of Webster, N.Y., by Nancy Fenity, executrix

[73] Assignee: Xerox Corporation, Stamford, Conn.

[22] Filed: Oct. 26, 1973

[21] Appl. No.: 409,993

Related U.S. Application Data

[62] Division of Ser. No. 104,498, Jan. 6, 1971, abandoned.

[52] U.S. Cl. ..... 96/1 SD; 252/62.1 R

[51] Int. Cl.[2] ..... G03G 9/02; G03G 13/08

[58] Field of Search ..... 96/1 R, 19 D, 1.5; 117/17.5; 427/25, 26; 252/62.1 P

[56] References Cited

UNITED STATES PATENTS

| | | | |
|---|---|---|---|
| 2,618,552 | 11/1952 | Wise | 117/17.5 |
| 3,272,644 | 9/1966 | Nelson | 96/1 SD |
| 3,545,968 | 12/1970 | Sato | 96/1 |
| 3,591,503 | 7/1971 | Hagenbach et al. | 252/62.1 P |
| 3,713,819 | 1/1973 | Hagenbach et al. | 96/1 SD |
| 3,767,578 | 10/1973 | Hagenbach et al. | 96/1 SD |

FOREIGN PATENTS OR APPLICATIONS

| | | |
|---|---|---|
| 267,059 | 4/1964 | Australia |

*Primary Examiner*—David Klein
*Assistant Examiner*—John L. Goodrow

[57] ABSTRACT

Electrostatographic developer comprised of a toner and an uncoated carrier wherein the carrier is a Group IV metal oxide or a double oxide of tin, hafnium, germanium, zirconium, or titanium and an alkaline earth or lead. These carriers have the desirable properties generally associated with the coated carriers heretofore employed in the art, but are not as prone as the coated carriers to degradation and impactation and therefore have a longer useful life.

11 Claims, No Drawings

ELECTROSTATIC DEVELOPMENT

This application is a divisional application of copending application Ser. No. 104,498, filed Jan. 6, 1971 now abandoned.

BACKGROUND OF THE INVENTION

This invention relates to electrostatography and more particularly to a new and improved composition and process for developing an electrostatic image.

Electrostatography is exemplified by the basic electrophotographic process taught by C. F. Carlson in U.S. Pat. No. 2,297,691, which involves placing a uniform electrostatic charge on a photoconductive insulating layer, exposing the layer to a light and shadow image to dissipate the charge on the areas of the layer exposed to the light and developing the resulting latent electrostatic image by depositing on the image a finely-divided electroscopic material referred to in the art as "toner". The toner is normally attracted to those areas of the layer which retain a charge, thereby forming a toner image corresponding to the latent electrostatic image, which may then be transferred to a support surface, such as paper. The transferred image is generally permanently affixed to the support surface by heating, although other suitable fixing means, such as solvent or overcoating treatment, may be substituted for the foregoing heat fixing step.

One method for applying the electroscopic material to a latent electrostatic image is the "cascade" process disclosed by L. E. Walkup in U.S. Pat. No. 2,618,551 and E. N. Wise in U.S. Pat. No. 2,618,552. In the cascade process, the developer is basically a two component system comprised of a finely divided electroscopic material (toner) and a carrier. The carrier is generally comprised of a core material, such as glass or sand, and a triboelectric resinous coating with the toner particles being loosely held on the coating by triboelectric action. The carrier and toner are chosen so that the toner assumes a charge of an opposite polarity to the latent electrostatic image, whereby upon rolling or cascading the developer over the surface bearing the electrostatic image, the toner particles are attracted to the image being developed. Conversely, if the toner particles have a charge of identical polarity to the latent electrostatic image, the toner particles accumulate on the background portions.

In automatic electrophotographic equipment, it is conventional to employ a photoconductive plate in the form of a cylindrical drum which is continuously rotated through a cycle of sequential operations including charging, exposure, developing, transfer and cleaning. The plate is usually charged with corona with positive polarity by means of a corona generating device of the type disclosed by L. E. Walkup in U.S. Pat. No. 2,777,957 which is connected to a suitable source of high potential and the charged plate is then exposed to a light and shadow image to dissipate the charge on the areas exposed to the light thereby forming a latent electrostatic image. A developer comprised of toner loosely held on a coated carrier is conveyed from a reservoir to a point above the drum bearing the latent electrostatic image and is allowed to fall and roll by gravity over the image-bearing surface thereby forming a powder image. The carrier along with any unused toner is returned to the reservoir for recycle through the development system. After forming a powder image on the electrostatic image during the development step, the powder image is electrostatically transferred to a support surface by means of a corona generating device such as the corona device mentioned above. In automatic equipment employing a rotating drum, a support surface to which a powdered image is to be transferred is moved through the equipment at the same rate as the periphery of the drum and contacts the drum in the transfer position interposed between the drum surface and the corona generating device. Transfer is effected by the corona generating device which imparts an electrostatic charge to attract the powder image from the drum to the support surface. The polarity of charge required to effect image transfer is dependent upon the visual form of the original copy relative to the reproduction and the electroscopic characteristics of a developing material employing to effect development. For example, where a positive reproduction is to be made of a positive original, it is conventional to employ a positive polarity corona to effect transfer of a negatively charged toner image to the support surface. When a positive reproduction from a negative original is desired, it is conventional to employ a positive charged developing material which is repelled by the charged areas on the plate to the discharge areas thereon to form a positive image which may be transferred by negative polarity corona.

The coated carrier presently employed in development compositions perform quite satisfactorily, but the time period over which such satisfactory performance can be expected is severely limited by two factors; namely, impactation or mechanical flow and/or degradation. The impactation or mechanical flow is caused by the continuous tumbling of the carrier in the development system, and as a result, toner particles adhere to the carrier surface. As the amount of toner adhering to the carrier surface increases, the triboelectric properties of the carrier material are changed and eventually such changes result in unsatisfactory reproduction. Similarly, continuous use of the carrier produces wear and chipping of the resinous coating, exposing the core material, and the use of such an exposed carrier results in print deletion and poor print quality.

The primary factors limiting the life of the carrier, i.e., impactation and degradation, are a direct result of the defects inherent in the use of a resinous coating. The resinous coatings, however, provide the properties required for an effective carrier; namely, low humidity sensitivity, good triboelectric qualities, and density. The low humidity sensitivity is required in order to prevent changes in the triboelectric properties of the carrier with changes in ambient conditions. The triboelectric qualities of the carrier are important in that the mutual electrification of the carrier and toner, i.e., their relative positions in the triboelectric series, is a determining factor in the overall quality of the resulting print. The density of the carrier is an important factor in preventing adherence of the carrier to the image-bearing surface. Therefore, the limitations directly resulting from the use of a coated carrier are tolerated in order to provide the properties required for effective development.

SUMMARY OF THE INVENTION

An object of this invention is to provide an improved developer for developing a latent electrostatic image.

Another object of this invention is to provide for improved development of electrostatic images.

A further object of this invention is to provide an improved developer for developing latent electrostatic images which overcomes the aforementioned difficulties associated with the carrier material.

These and other objects of the invention should be more readily apparent from reading the following detailed description thereof.

The objects of this invention are broadly accomplished by providing an electrostatographic developer comprised of a toner and an uncoated solid carrier comprised of a crystalline material which is either an oxide of a Group IV element, or a double oxide of titanium, zirconium, tin, hafnium, or germanium and an alkaline earth or lead. These materials possess the properties required for an effective electrostatographic developer carrier without the application of a resinous coating thereto and, therefore, are not as susceptible to degradation and/or mechanical flow as the coated carriers heretofore employed in the art.

DETAILED DESCRIPTION OF THE INVENTION

In accordance with the invention, an electrostatographic developer carrier is formed of a material comprised of one or more of the following: (1) crystalline oxides of Group IV elements, particularly zirconium dioxide, titanium dioxide, tin oxide, germanium oxide, hafnium oxide and lead oxide, with the oxides of germanium or hafnium generally being less preferred in that such oxides are very expensive, and (2) the crystalline double oxides of titanium, zirconium, tin, hafnium or germanium and either an alkaline earth, in particular calcium, strontium and barium; or lead, in particular the titanates, zirconates, and stannates of one or more of the alkaline earths or lead, such as lead titanate ($PbTiO_3$), lead zirconate ($PbZrO_3$), lead stannate ($PbSnO_3$), barium titanate ($BaTiO_3$), calcium titanate ($CaTiO_3$), barium zirconate ($BaZrO_3$), calcium zirconate ($CaZrO_3$), barium stannate ($BaSnO_3$), calcium stannate ($CaSnO_3$), barium strontium titanate ($BaSrTiO_3$), barium calcium titanate ($BaCaTiO_3$), etc., and mixtures thereof, such as a solid solution of lead titanate and lead zirconate. A crystalline carrier of zirconium dioxide has been found to provide particularly good results.

In using the developer in a cascade development technique, the carrier material is employed in a size and form to provide flow properties which enable the carrier to roll across a latent electrostatic image-bearing surface without being retained by toner particles attracted to the image-bearing surface. The particle size of the carrier is preferably larger than about 30 microns, preferably from about 30 to about 1000 microns, although other sizes could be used which will enable the carrier to flow easily over the image-bearing surface without requiring special means or measures for effecting removal of the carrier particles from the image-bearing surface.

The developer carriers generally employed in the art have a spherical shape, but it is to be understood that the carriers of the invention may be employed in non-spherical shapes, with such non-spherical shapes preferably having no sharp corners or edges to cause excessive scratching and wear of the latent image-bearing photoconductive surface. Some of the carriers of the invention may be sperodized in much the same manner as the glass bead carriers heretofore employed in the art, although at higher temperatures. The carrier materials which are not easily spheroodized are ground to the proper particles size and are then preferably further treated, for example in a ball mill, to grind off the rough areas and produce rounded particles.

The uncoated carrier materials of the invention are employed in an electrostatographic developer composition by loosely coating any suitable pigmented or dyed electroscopic toner material thereon, the toner material being affixed to the carrier by electrostatic attraction. Typical toner materials include: gum copal, gum sandarac, rosin, cumaroneindene resin, asphaltum, gilsonite, phenol-formaldehyde resins, rosin-modified phenol-formaldehyde resins, methacrylic resins, polystyrene resins, polypropylene resins, epoxy resins, polyethylene resins, polyamide resins, and mixtures thereof. The particular toner material to be employed obviously depends upon the separation of the toner particles from the carrier in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re. 25,136 to Carlson and U.S. Pat. No. 2,788,288 to Rheinfrank et al. These toners generally have an average particle diameter between about 1 and about 30 microns.

The degree of contrast or other photographic qualities of the finished image produced with the electrostatographic deloper compositions of the invention may be varied by changing the relative proportions of toner and carrier material and the choice of optimum proportions is deemed to be within the scope of those skilled in the art. In general, however, the developer compositions of the invention have carrier to toner weight ratios of from about 25:1 to about 1000:1, preferably from about 75:1 to about 100:1, to produce a dense readily transferable image.

The invention will be further described with reference to the following examples, which are illustrative of preferred embodiments of the invention but it is to be understood that the scope of the invention is not to be limited thereby. In the following examples all parts and percentages are by weight.

EXAMPLE I

A developer is prepared using spherodized crystalline zirconium dioxide (20–40 mesh) as the carrier and a toner comprising a styrene-n-butyl methacrylate copolymer, polyvinyl butyral and carbon black produced as disclosed in Example I of U.S. Pat. No. 3,079,324 to Insalaco, the developer composition having 0.6%, by weight, of the toner.

The developer is used to develop a latent electrostatic image by cascading the developer (three times) over a latent electrostatic image formed on a flat selenium plate charged to 700 volts. The image is transferred using 700 volts and after fusing the prints are examined.

The prints have low background and very good resolution and the carrier does not stick to either the plate or print.

The hereinabove described developer is used in a Xerox 914 machine, at 0.3% toner concentration, by weight, and produces fine results for a test run of 120,000 copies i.e., no degradation of print quality, little if any physical wear of the carrier, no sticking of the carrier to the print or drum, no drum scratching, very little humidity sensitivity, low powder cloud development in developer housing (cleaner machine operation) and good print quality with low backround.

EXAMPLE II

The toner described in Example I is combined with an uncoated solid crystalline carrier formed of titanium dioxide (average particles size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE III

The toner described in Example I is combined with an uncoated solid crystalline carrier formed of lead titanate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE IV

The toner described in Example I is combined with an uncoated solid crystalline carrier formed of lead zirconate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE V

The toner described in Example I is combined with an uncoated solid crystalline carrier formed of barium titanate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE VI

The toner described in Example I is combined with an uncoated solid crystalline carrier formed of calcium titanate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE VII

The toner described in Example I is combined with an uncoated solid crystalline carrier formed of barium strontium titanate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE VIII

The toner described in Example I is combined with an uncoated solid crystalline carrier formed of a solid solution of lead titanate and lead zirconate (average particle size 600 microns) in an amount to provide a developer containing 0.6%, by weight, of the toner.

The composition is employed to develop a latent electrostatic image on a flat selenium plate charged to 700 volts. The image is transferred using 700 volts, and after fusing, the prints are examined.

The prints obtained are of good quality and the carrier does not stick to either the plate or print.

EXAMPLE IX

Examples I–VIII are repeated with a toner comprising a propoxylated bisphenol A fumarate polyester (ATLAC 382, sold by Atlas Chemical Industries, Inc.) and carbon black with similar results.

The improved electrostatographic developers of the present invention may be employed for developing a latent electrostatographic image in any one of a wide variety of processes which employ two-component developers. Thus, although the invention has been particularly described with reference to a cascade type of development, the developers of the present invention may also be used for fluidized development, as described for example in U.S. Pat. No. 3,380,437 to Swyler or U.S. Patent No. 3,393,663 to Donalies.

Similarly, although the invention has been particularly described with reference to developing latent images formed by an electrophotographic technique, the developer may also be employed for developing latent images formed by other techniques, e.g., pulsing electrodes, as used for example in electrostatic printing processes.

The electrostatographic developer compositions of the present invention are an improvement over those heretofore employed in the art in that the carriers thereof, although uncoated, have the density, humidity insensitivity and triboelectric qualities required for an effective carrier. As a result, there carriers are not prone to impactation and degradation, thereby increasing the effective life of the carrier. In addition, developer compositions employing the carrier materials of the invention are capable of developing an image at a more rapid rate than developers heretofore employed in the art and are therefore of interest as developers for high rate machines in which the contact time between the developers and the latent image-bearing surface may be limited.

Numerous modifications and variations of the present invention are possible in light of the above teachings and therefore the invention may be practised otherwise than as particularly described.

What is claimed is:

1. A process for providing a visible image from a latent electrostatic image, comprising:

passing over an electrostatic latent image-bearing surface an electrostatographic developer composition consisting of a toner material electrostatically clinging to an uncoated carrier having an average diameter of from between about 30 and about 1,000 microns, said carrier consisting of a material containing at least one member selected from the group consisting of crystalline double oxides of a member selected from the group consisting of titanium, hafnium, zirconium, tin and germanium and at least one member selected from the group consisting of alkaline earths and lead, whereby said toner material is attracted to said surface to render said latent image visible.

2. The process as defined in claim 1 wherein said carrier is lead titanate.

3. The process as defined in claim 1 wherein said carrier is lead zirconate.

4. The process as defined in claim 1 wherein said carrier is calcium titanate.

5. The process as defined in claim 1 wherein said carrier is a solid solution of lead titanate and lead zirconate.

6. A process for forming and developing an image on a photoconductive insulating surface, comprising:

placing an electrostatic charge on a photoconductive insulating surface; exposing the surface to a light and shadow image to dissipate the charge on the areas exposed to light to produce an electrostatic latent image; the improvement comprising developing the image with an electrostatographic developer composition consisting of a toner material in association with an uncoated carrier having an average diameter of from between about 30 and about 1,000 microns, said carrier consisting of a material containing at least one member selected from the group consisting of crystalline double oxides of a member selected from the group consisting of titanium, hafnium, zirconium, tin, and germanium and at least one member selected from the group consisting of alkaline earths and lead.

7. An electrostatographic imaging process comprising the steps of forming an electrostatic latent image on a recording surface and developing said electrostatic latent image by contacting said recording surface with an electrostatographic developer mixture consisting of finely-divided toner particles having an average particle diameter between about 1 micron and about 30 microns electrostatically clinging to the surface of carrier particles having an average diameter from between about 30 to about 1,000 microns, said carrier particles consisting of an uncoated, solid crystalline material consisting of at least one member selected from the group consisting of crystalline double oxides of a member selected from the group consisting of titanium, hafnium, zirconium, tin, and germanium and at least one member selected from the group consisting of alkaline earths and lead, said carrier particles and said toner particles being present in weight of from about 25:1 to about 1000:1, whereby at least a portion of said finely-divided toner particles are attracted to and held on said recording surface in conformance to said electrostatic latent image.

8. An electrostatographic imaging process according to claim 7 wherein said carrier particles consist of lead titanate.

9. An electrostatographic imaging process according to claim 7 wherein said carrier particles consist of lead zirconate.

10. An electrostatographic imaging process according to claim 7 wherein said carrier particles consist of calcium titanate.

11. An electrostatographic imaging process according to claim 7 wherein said carrier particles consist of a solid solution of lead titanate and lead zirconate.

* * * * *